US012564917B2

(12) United States Patent
Umbrell

(10) Patent No.: US 12,564,917 B2
(45) Date of Patent: Mar. 3, 2026

(54) BUFFING PAD

(71) Applicant: Buff and Shine Manufacturing, Inc., Rancho Dominguez, CA (US)

(72) Inventor: Richard Umbrell, Rancho Dominguez, CA (US)

(73) Assignee: Buff and Shine Mfg., Inc., Rancho Dominguez, CA (US)

( * ) Notice: Subject to any disclaimer, the term of this patent is extended or adjusted under 35 U.S.C. 154(b) by 45 days.

(21) Appl. No.: 17/949,918

(22) Filed: Sep. 21, 2022

(65) Prior Publication Data

US 2024/0375247 A1 Nov. 14, 2024

Related U.S. Application Data

(63) Continuation-in-part of application No. 29/847,822, filed on Jul. 28, 2022, now abandoned, and a continuation-in-part of application No. 29/808,610, filed on Sep. 21, 2021, now abandoned.

(51) Int. Cl.

| | |
|---|---|
| ***B24D 13/14*** | (2006.01) |
| ***A47L 11/162*** | (2006.01) |
| ***B24D 9/08*** | (2006.01) |

(52) U.S. Cl.

CPC ..... *B24D 13/147* (2013.01); *B24D 9/08* (2013.01); *A47L 11/162* (2013.01)

(58) Field of Classification Search

CPC ..... A47L 11/162; B24D 13/147; B24D 9/08

See application file for complete search history.

(56) References Cited

U.S. PATENT DOCUMENTS

| | | | | |
|---|---|---|---|---|
| 1,739,294 | A * | 12/1929 | Despret | B24D 9/08 15/230.19 |
| 2007/0254567 | A1* | 11/2007 | McLain | B24D 13/147 451/490 |
| 2011/0247651 | A1* | 10/2011 | Neumann | A47L 25/005 15/40 |
| 2013/0157552 | A1* | 6/2013 | Kolthoff | B24D 13/147 451/548 |

* cited by examiner

*Primary Examiner* — Andrew A Horton

(74) *Attorney, Agent, or Firm* — Fitzsimmons IP Law

(57) ABSTRACT

A buffing pad assembly having a buffing pad, an attachment means, and an insert (e.g., plastic ring) is provided. In one embodiment, a channel is cut into a side of the buffing pad, creating first and second side portions. The attachment means is then affixed (glued) to a back surface of the buffing pad and the insert is centered on an upper surface of the attachment means. The insert is then heated, affixing it to the upper surface of the attachment means. The insert is then deformed (while it is still pliable) into an L-shape, forming a cavity on the backside of the buffing pad assembly. And because the insert is affixed to the attachment means, and the attachment means is affixed to the buffing pad, deforming the insert results in deforming the back surface of the buffing pad, while maintaining a flat front surface.

20 Claims, 12 Drawing Sheets

BUFFING PAD

BACKGROUND OF THE INVENTION

1. Field of the Invention

The present invention is directed toward a buffing and/or polishing pad, and more particularly, to a buffing and/or polishing pad that is more robust, provides for heat dissipation, and can be used with traditional rotating and/or orbiting devices.

2. Description of Related Art

Buffing refers to the application of a chemical or compound to a surface using a buffing pad. In the automotive detailing industry, for example, buffing is used to repair, refinish or polish the exterior surfaces of automobiles. Buffing can be done by hand. However, professionals and consumers alike prefer to use buffing pads with power buffers. A power buffer can be pneumatic, in which the power is supplied by an air compressor, or motorized, in which the power is supplied by an electric motor. A motorized power buffer is a hand-held tool having a buffing pad attached to a spindle that extends from the electric motor. The motor spins the buffing pad and thus results in faster performance, while reducing fatigue on the operator. It also allows the operator to get optimum finishing effects as compared to buffing by hand.

There are two types of motorized power buffers, including high-speed rotary buffers and dual-action or random orbital buffers. The main difference between the two relates to the direction of the rotation of the buffing pad assembly, which in turn produces different results. High-speed buffers provide a circular motion, spinning at very high continuous revolutions per minute (RPMs) and can have either one or two buffing pads attached to the motor. For example, a dual-head buffer is a high-speed rotary buffer having two buffing pads attached to the motor, adjacent to each other. Dual-action or random-orbital buffers turn in a combined circular and orbital motion, at varying speeds. The continuous revolutions of either type of buffer causes friction on contact with the surface producing heat, that when combined with a compound alters the surface of the automobile. Power buffers are used for various purposes, including repairing damages to surfaces or for different finishing effects. The buffing pads are usually circular, are made in varying sizes, and are made of various materials, such as natural wool, synthetic fibers, a blend of wool and synthetic fibers or open or closed cell synthetic foam.

One of the latest generations of known rotary and random orbital buffing devices include a buffing pad attached to a buffing device back plate as shown in FIGS. 1A through 1C. The buffing device is capable of being connected to a powered head-unit that physically connects to the back plate.

In FIG. 1A, a perspective view is shown of a buffing device back plate (simply referred to as the "back plate") 100 separated from a buffing pad 102. The back plate 100 may have a back surface 104, connection member 106, optional connection rod 108, edge 110, and front surface (not shown). The buffing pad 102 may have an outer surface 112, back surface 114, inner surface 116, and inner wall surface 118. In FIG. 1B, a perspective view is shown of both the back plate 100 and buffing pad 102 physically connected together. Similarly, in FIG. 1C, a side view is shown of both the back plate 100 and buffing pad 102 physically connected together along the front surface 120 of the back plate 100 and the inner surface 116 of the buffing pad 102. From FIG. 1C, it is appreciated that the edge 110 of the back plate 100 is resting against the inner surface 116 and inner wall surface 118 of the buffing pad 102 at a contact point 122.

Typically, the back surface 104 and connection member 106 of the back plate 100 are constructed of a hard material such as metal, wood, plastic, epoxy resin, polyurethane, or other rigid materials. The optional connection rod 108 may be a threaded rod made of hard material that is capable of physically engaging the buffing device powered head-unit (not shown). If no optional connection rod 108 is utilized, the connection member 106 may include a threaded shaft (not shown) within the connection member 106 that is capable of physically engaging the buffing device powered head-unit with a threaded rod.

Generally, the outer surface 112 of the buffing pad 102 is constructed of soft or semi-soft material for use in polishing a surface. The material may include foam, polyurethane, wool, or other material used for polishing surfaces. The inner surface 116 and inner wall surface 118 of the buffing pad 102 define the surfaces of a cavity 124 within the buffing pad 102. The cavity 124 generally assists in roughly centering the back plate 100 to the buffing pad 102.

Such systems have several drawbacks. First, when the cavity 124 itself is being used to center the back plate 100 and prevent the back plate 100 from hitting any external surface, the violent motion associated with an orbital buffing device can result in the edge 110 of the back plate 100 cutting into the cavity 124, or the inner wall surface thereof 118. This can result in the buffing pad 102 being destroyed prematurely.

One solution is to add a plastic "cup" to the cavity 124, where the "cup" includes sides and a bottom that resides between the inner surface 116 of the buffing pad 102 and an attachment means (e.g., fabric hook-and-loop fasteners) (not shown). A problem with this solution is that the "cup" prevents the buffing pad 102 from breathing (due to the plastic residing between the attachment means and the inner surface of the buffing pad), which is problematic, especially when the buffing pad is used with a random orbital buffing device. And if the buffing pad does not "breath," and excess heat is generated, the buffing pad (or elements thereof, e.g., fabric hook-and-loop fasteners) may start to melt, resulting in premature failure of the buffing pad and/or surfaces/components thereof.

And if a plastic "cup" is not used, the back plate 100 may cut into the cavity 124, or the inner wall surface thereof 118 (see discussion above), thereby resulting in unwanted vibration, which can cause operator fatigue and annoyance, undesirable buffing results, premature wear of the bearings of the powered head-unit, potential damage to the buffing pad 100, etc. In addition, objects moving with combined rotational and orbital motion experience violent forces that can significantly amplify the problems associated with uncentered spinning objects. This motion places heavy stress on the hook-and-loop fabric (not shown) holding the buffing pad 102 to the back plate 100. Typically, this motion is so violent that it can shear the loops on the inner surface 116 of the buffing pad 100 and create heat that is capable of loosening the adhesives that typically attach the hook-and-loop fabric on to the buffing pad 100.

In light of the foregoing, there is a need for a system capable of solving the above-described problems with known buffing pads, and in particular, for a buffing and/or polishing pad assembly that is resilient, provides for heat dissipation, and can be used with traditional rotary and random orbital buffing devices. In addition, the buffing pad assembly should be relatively easy and cost effective to manufacture.

SUMMARY OF THE INVENTION

The present invention provides a buffing pad assembly that overcomes the aforementioned drawbacks in the prior art. In preferred embodiments of the present invention, the buffing pad assembly includes a buffing pad, an attachment means (e.g., Velcro™), and an insert (e.g., plastic ring) that can be heated and deformed to create a cavity on a backside of the buffing pad assembly.

In one embodiment of the present invention, the buffing pad has at least one edge, a front surface and a back surface having a cavity, where the cavity is configured to receive an attachment means (e.g., Velcro™) and an insert. In a preferred embodiment of the present invention, the insert functions to protect the inner wall surface of the buffing pad from the backing plate during violent forces generally associated with traditional rotary or orbital buffing devices. In one embodiment, the insert is an L-shaped "ring" that protects the cavity (or inner) wall surface, but is not continuous on the cavity bottom, thereby providing for heat dissipation.

In one embodiment, the insert is (at least partially) under the attachment means, or between at least a portion of the attachment means and the buffing pad (or the cavity provided therein). This prevents the backing plate from getting under the edge of the insert, which can result in the insert being "lifted" (or detached) from the buffing pad. In an alternate (preferred) embodiment, the insert is (at least partially) above the attachment means. In either embodiment, heat can be applied to the insert to affix the insert to the attachment means and/or buffing pad (e.g., by heating the insert to its melting point).

In one embodiment, heat is used to both affix the insert to the attachment means and/or buffing pad and to create a cavity on the backside of the buffing pad assembly. In particular, the insert (or plastic ring) may be heated to its melting point, thereby affixing (melting) the insert to the attachment means and/or buffing pad. The insert may then be heated (again) (or cooled) to its glass transition temperature (rendering it pliable), so that the insert can be deformed into a desired shape (e.g., a cavity).

In one embodiment, prior to heating/deforming the insert, a "channel" is cut into the side of the buffing pad, resulting in a first outer surface and a second outer surface, where the shape of the "channel" varies depending on the profile desired. After the channel has been cut into the side of the buffing pad (or prior, depending on the assembly process), the attachment means is affixed to the back surface of the buffing pad (e.g., using heat-resistant glue) and the insert is then centered (e.g., via a jig) on the upper surface of the attachment means. As discussed above, the insert should preferably be ring-shaped for heat dissipation, reduced pad distortion, etc.

A first tool having at least one heating element is then used to heat the insert to its melting point, thereby affixing the insert to the upper surface of the attachment means, which in turn is affixed to the back surface of the buffing pad. A second tool may then be used to deform (or shape) the insert into a cavity. And because the insert is affixed to the attachment means (or a portion thereof), and the attachment means is affixed to the buffing pad (or a portion thereof), deforming the insert results in deforming (a) edges of the attachment means and (b) edges of the buffing pad, thereby creating a "layered" cavity. And because of the channel, the front surface of the buffing pad can remain flat, while the back surface is deformed into a cavity. Not only does this provide a protective layer for the cavity sides, but it simplifies (and therefore reduces the cost of) the manufacturing process.

A more complete understanding of a buffing pad assembly will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The present invention provides a buffing pad assembly that includes a buffing pad, an attachment means, and an insert that can be heated and deformed to create a cavity on a backside of the buffing pad assembly. This invention addresses problems found in traditional buffing pad assemblies, including, heat dissipation, robustness, and difficulties and expenses in manufacturing. In the detailed description that follows, like element numerals are used to describe like elements shown in one or more of the figures.

In general, the assembly comprises a buffing pad having at least one edge, a front surface and a back having a cavity, where the cavity is configured to receive an attachment means and an insert. In a preferred embodiment of the present invention, the insert functions to protect the inner wall surface of the buffing pad from the backing plate during violent forces generally associated with traditional rotary or orbital buffing devices. In alternate embodiments, the insert can also (or alternatively) function to substantially center the buffing pad on the backing plate (e.g., sized to receive a corresponding back plate).

Figure 2A:
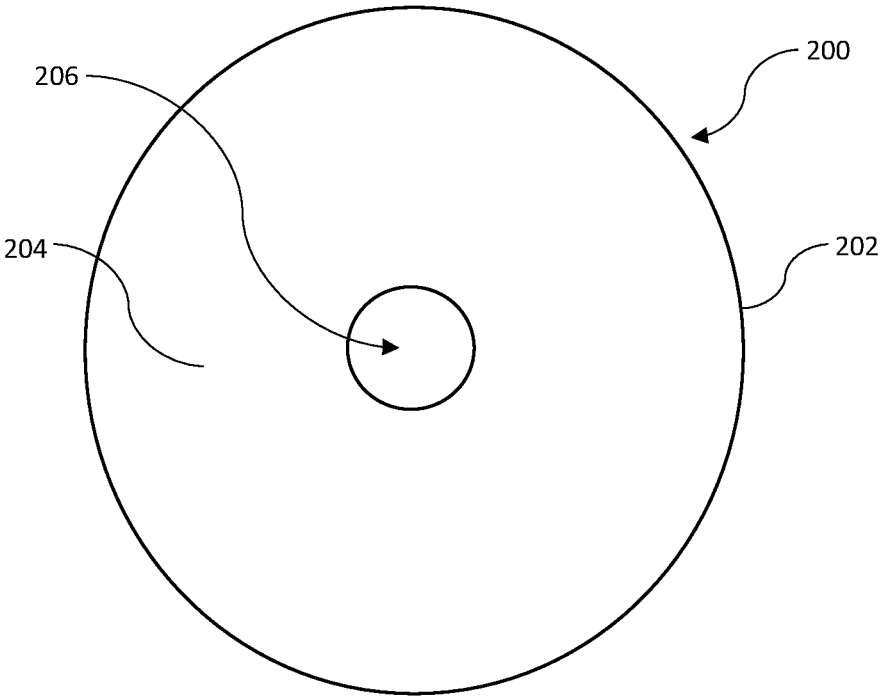
FIG. 2A is a front, planar view of a buffing pad assembly in accordance with one embodiment of the present invention.
Figure 2B:
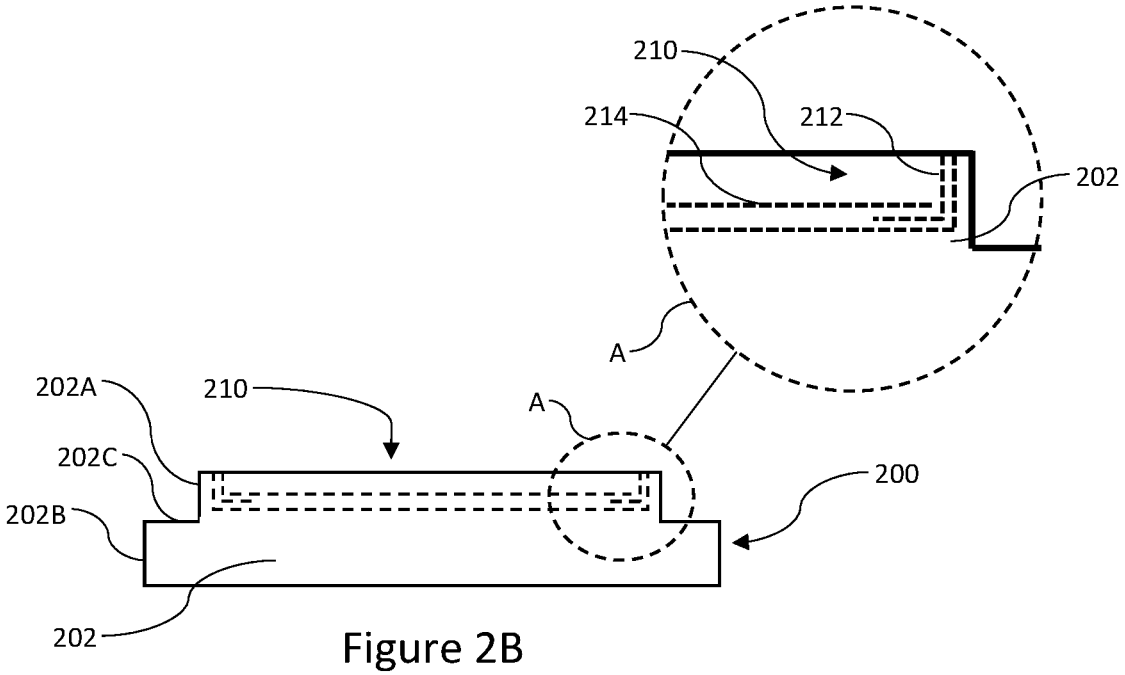
FIG. 2B is a side view of the buffing pad assembly illustrated in FIG. 2A.

In a preferred embodiment, as shown in FIG. 2A and 2B, the buffing pad assembly 200 includes a buffing pad 202 having a substantially smooth front surface 204 and an aperture 206, which may be used for attaching the plate to a rotary or orbital device (not shown) or for heat dissipation (as known in the art). It should be appreciated that a buffing pad assembly 200 (or buffing pad 202) that does not include an aperture 206, or includes other features not shown in FIG. 2A (e.g., designs, patterns, logos on the front surface 204, etc.), is within the spirit and scope of the present invention. It should also be appreciated that the buffing pad 202, including the front surface 204 thereof, may be constructed of one or more materials generally known to those skilled in the art, including natural wool, synthetic fibers, a blend of wool and synthetic fibers, open or closed cell synthetic foam, etc. The invention will also work with other types of pads, including nylon brush pads and other buffing, polishing, and/or abrasive (e.g., metal, stone, ceramic, fiber (woven and non-woven), sand, nylon, polypropylene, etc.) pads generally known to those skilled in the art.

Figure 2C:
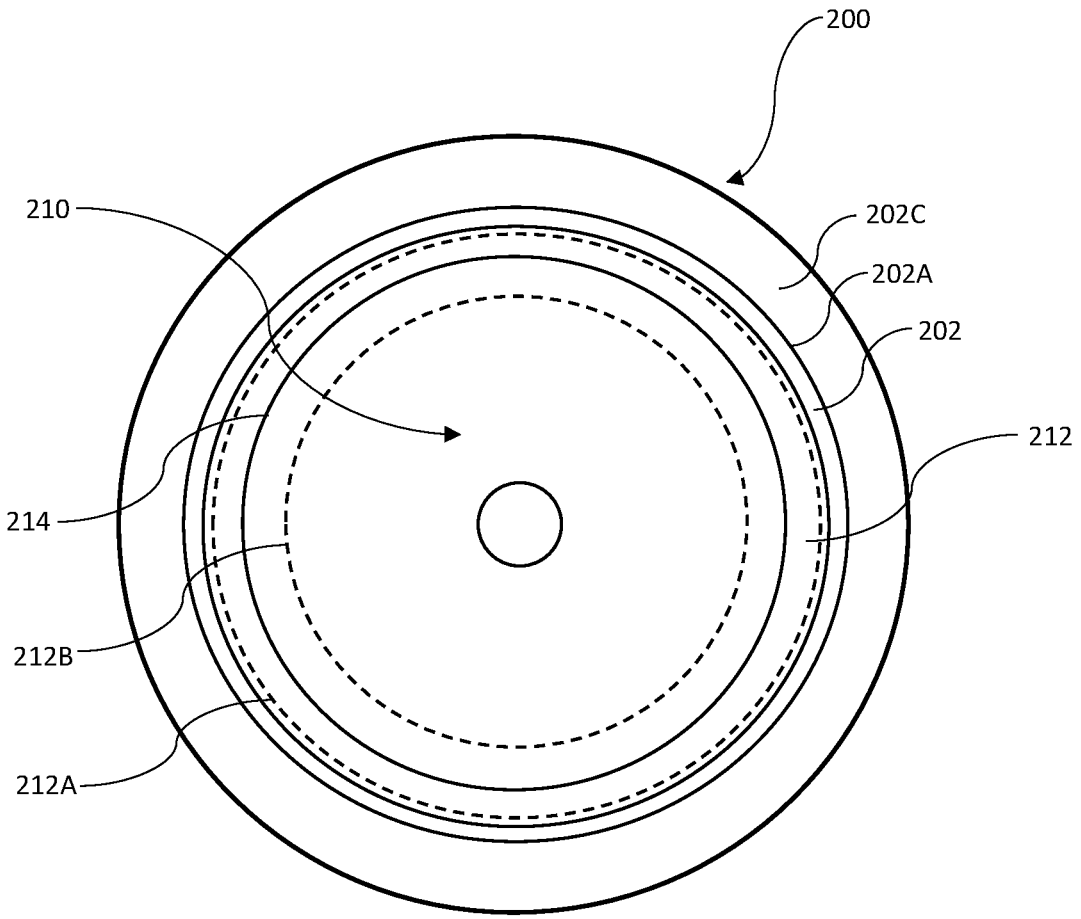
FIG. 2C is a back, planar view of the buffing pad assembly illustrated in FIG. 2A FIGS. 2D and 2E are planar and cross-sectional views, respectively, of an insert in accordance with one embodiment of the present invention.

As shown in FIGS. 2B and 2C, the back of the buffing pad 202 should include a cavity 210 sized to accept a back plate (not shown). In a preferred embodiment, the cavity 210 includes an attachment means 214, such as fabric loop-and-hook fasteners (e.g., Velcro™), and an insert 212 to prevent the back plate from cutting into or damaging the cavity (or inner) wall surface. The insert, however, should be more of an L-shaped "ring" that protects the cavity (or inner) wall surface, but is not continuous on the cavity bottom.

Figure 2D:
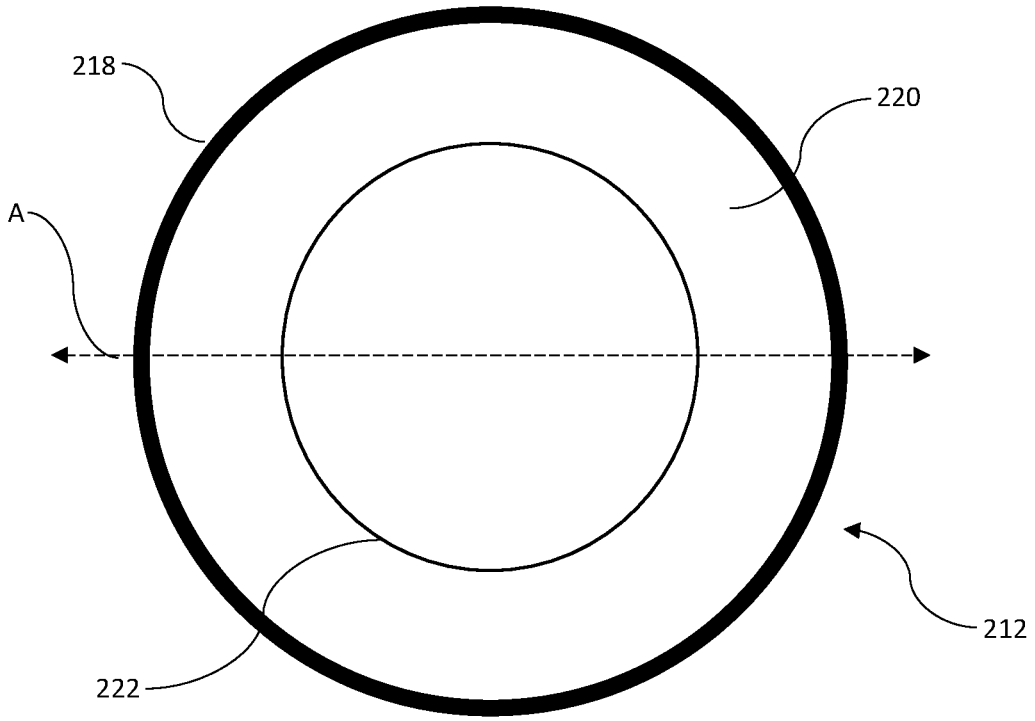
Figure 2E:
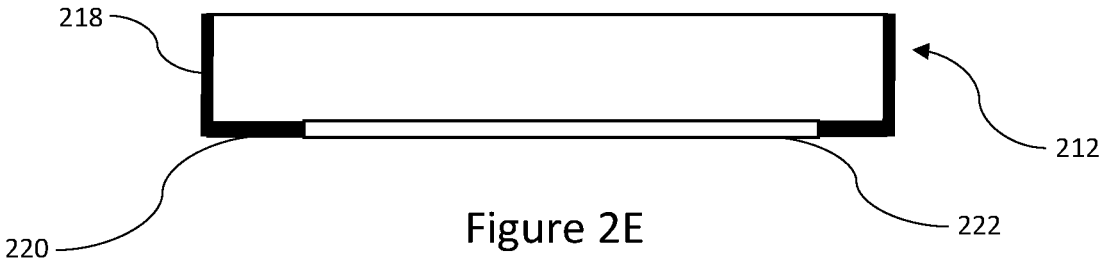

An exemplary insert 212 is shown in FIGS. 2D and 2E, with FIG. 2D providing an upper view of the insert 212 and FIG. 2E providing a cross-sectional view of the insert 212 (taken at "A" in FIG. 2D). These figures show that the insert 212 is L-shaped and includes a substantially vertical side wall 218 and a substantially horizontal bottom 220, where the bottom 220 includes an aperture 222. It is this aperture 222 (or "ring" shape) that allows the buffing pad 202, including the attachment means 214, to breath, thereby preventing (or minimizing) thermal damage. As discussed above, excess heat can cause premature failure of the buffing pad and/or surfaces/components thereof (e.g., the attachment means 214, etc.).

It should be appreciated that while FIGS. 2A-E depict one embodiment of the present invention, the invention is not so limited. For example, while a non-continuous insert ("ring" shaped) is preferred, a "cup" providing a barrier between the cavity bottom and the attachment means is within the spirit and scope of the present invention, as are other attachment means (e.g., adhesive, etc.) generally known to those skilled in the art (e.g., a "cup" having a perforated bottom for heat dissipation is within the spirit and scope of the present invention). While the insert is preferably plastic, which is pliable under heated conditions (allowing it to be formed into an L-shape, or the like), but sufficiently resilient enough under normal (operable) conditions to protect the cavity (inner) wall surface from the back plate, other constructions (e.g., an insert constructed using at least one other material) (e.g., carbon fiber, fiberglass, metal, etc.) are within the spirit and scope of the present invention. It should also be appreciated that while the insert is shown as L-shaped, with a 90° bend at 212A, other shapes, including a more curved transition between the vertical side wall 218 and horizontal bottom 220, is within the spirit and scope of the present invention.

In one embodiment, the bottom 220 of the insert 212 is (at least partially) under the attachment means 214, or between at least a portion of the attachment means 214 and the bottom of the cavity 210. See, e.g., FIG. 2B. This prevents the backing plate (not shown) from getting under the edge of the insert 212, which can result in the insert 212 being "lifted" (or detached) from the buffing pad. Also, if heat is used to shape the insert (e.g., using a mold or jig) (see discussion below), and this is done while the insert 212 and the attachment means 214 are positioned within the cavity 210, the melted plastic of the insert 212 can be used to not only secure the insert 212 to the buffing pad 202, but also secure the attachment means 214 to the buffing pad 202 (e.g., the attachments means 214 is secured to the insert 212, which in turn is secured to the buffing pad 202).

It should be appreciated that other means (e.g., heat-resistant glue, etc.) can also or alternatively be used to affix the insert 212 and/or attachment means 214 to the buffing pad. It should also be appreciated that the attachment means 214 is not limited to fabric hook-and-loop fasteners (e.g., Velcro™), and other fastening means are within the spirit and scope of the present invention. It should further be appreciated that the present invention is not limited to the arrangement of the insert 212 and attachment means 214 shown in FIG. 2B, and other arrangements are within the spirit and scope of the present invention. For example, the insert 212 could be disposed (at least partially) on top of the attachment means 214 (discussed in greater detail below).

If the buffing pad is constructed as discussed above, several other benefits are achieved, including a buffing pad shape that is conducive to buffing in tight spots. As shown in FIG. 2B, the buffing pad may include a first outer surface 202A and a second outer surface 202B, where the first outer surface 202A has a smaller circumference (and diameter) than the second outer surface 202B. It also results in a "notch" 202C that is formed between the first and second outer surfaces 202A, 202B. This "notch," including the reduced circumference or diameter, can prevent the backing plate and/or insert from contacting (e.g., scratching, etc.) the surface that is being buffed or polished and can allow the buffing pad 202 to be used in tight spots.

Figure 3A:
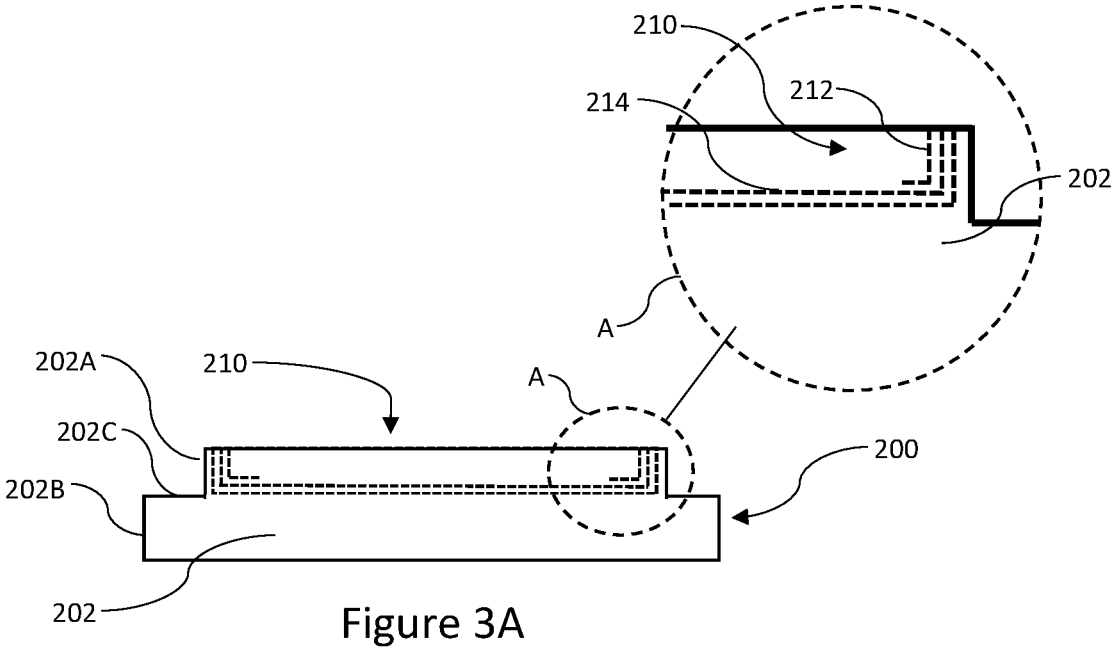
FIG. 3A is a side view of a buffing pad assembly in accordance with another embodiment of the present invention.
Figure 15:
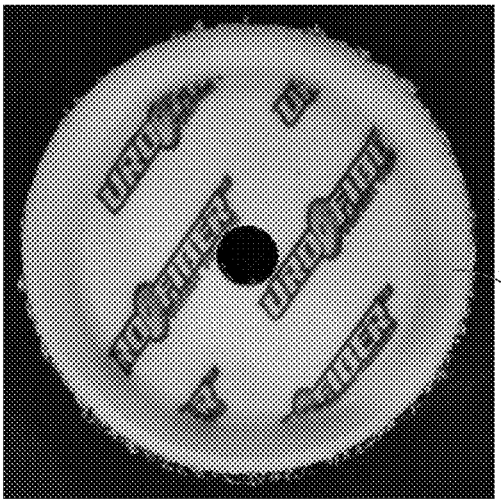
FIGS. 15 and 16 are top and perspective views, respectively, of the buffing pad assembly shown in FIGS. 13 and 14, after deformation.
Figure 16:
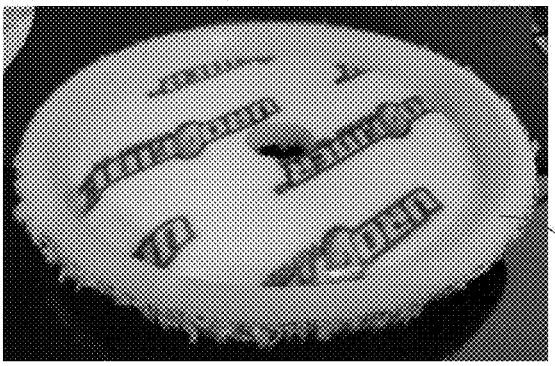

As stated above, the present invention is not limited to the foregoing embodiments, and other embodiments are within the spirit and scope of the present invention. For example, as shown in FIG. 3A, the insert 212 could be disposed (at least partially) on top of the attachment means 214. In this embodiment, the attachment means 214 is affixed to at least the cavity bottom (e.g., via heat-resistant glue, etc.) and perhaps the cavity sides. The insert 212, which is preferably a plastic ring, is affixed to an upper surface of the attachment means 214. In a preferred embodiment, this is accomplished by heating the insert 212 (or plastic ring) to a melting point, thereby affixing the insert 212 to an upper surface of the attachment means 214. Heating the insert 212 could also be used to affix the insert 212 to the back surface of the buffing pad (see, e.g., FIGS. 15 and 16) (e.g., if the diameter of the insert 212 is greater than the diameter of the attachment means 214). And if the insert is heated, this is but another reason the insert should be ring-shaped, as heat and pressure can negatively affect the buffing pad (e.g., causing pad distortion, etc.). In other words, by only having to apply heat at the edges (e.g., to melt the ring-shaped plastic), it is less likely that the center of the buffing pad is distorted, etc.

Figure 3B:
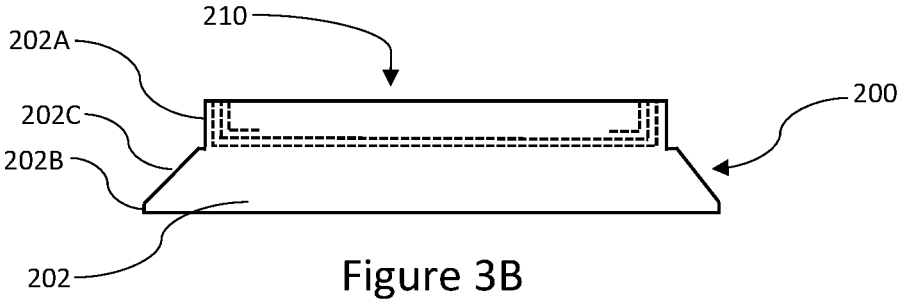
FIG. 3B is a side view of a buffing pad assembly in accordance with yet another embodiment of the present invention.

It should be appreciated that the present invention is not limited to the embodiment shown in FIG. 3A, as this is merely an alternate embodiment. For example, the "notch" 202C referred to above may be more of an angled, or slopped surface (see FIG. 3B), depending on how the buffing pad 202 is cut, or the shape of the "channel" cut into the side of the buffing pad 202 (discussed in greater detail below). As those skilled in the art will appreciated, a buffing pad assembly having a side profile as shown in FIG. 3B may be advantageous over other profiles as it allows the user to get the buffing pad into tighter (or smaller) spots.

Figure 1A:
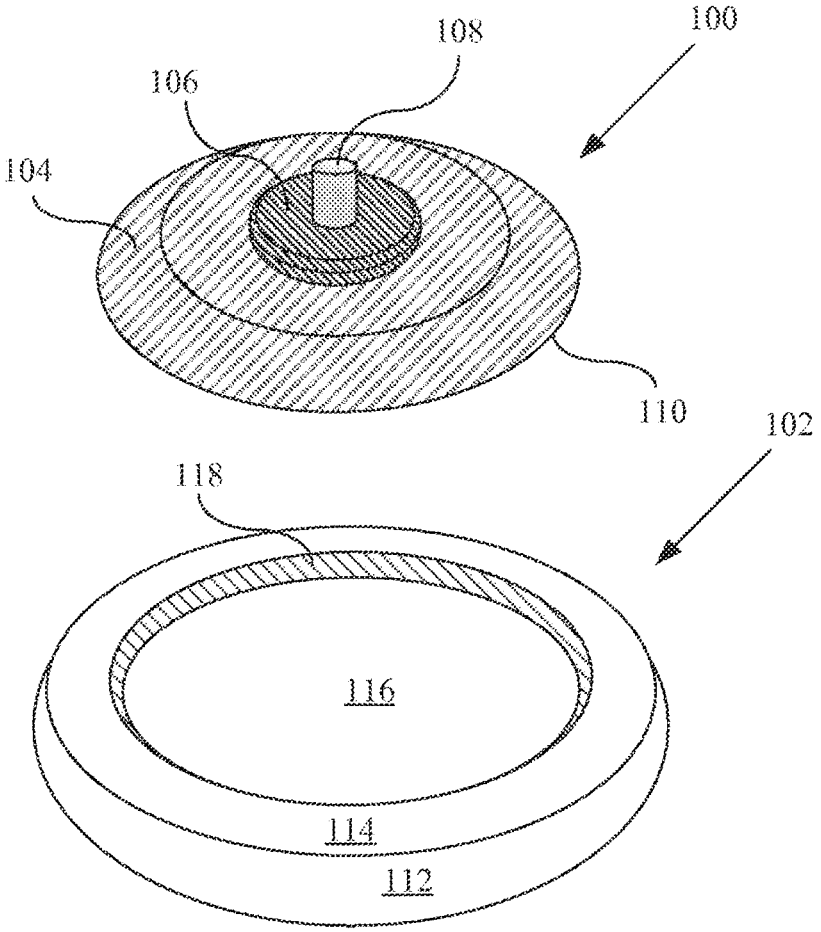
Figure 1A (Prior Art)
FIG. 1A is a perspective view of a known buffing device back plate separated from a buffing device buffing pad.
Figure 1B:
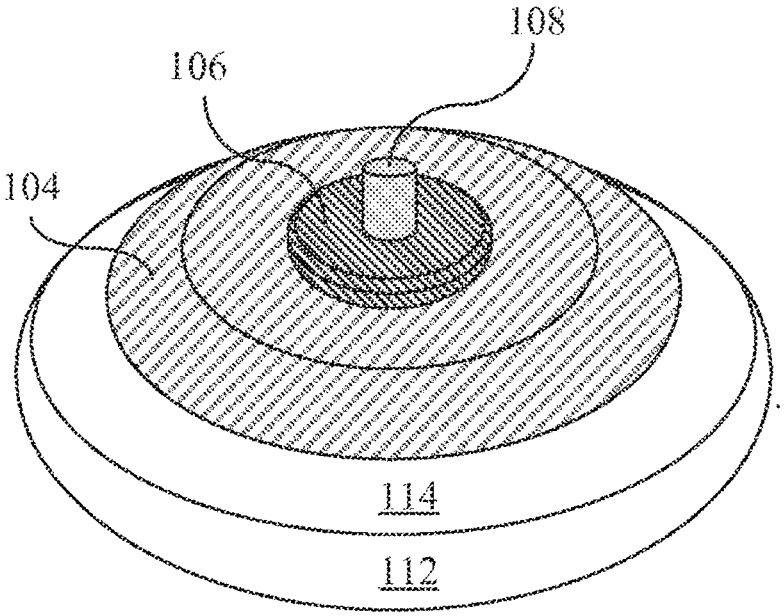
Figure 1B (Prior Art)
FIG. 1B is a perspective view of both the back plate and buffing pad, shown in FIG. 1A, physically connected together.
Figure 1C:
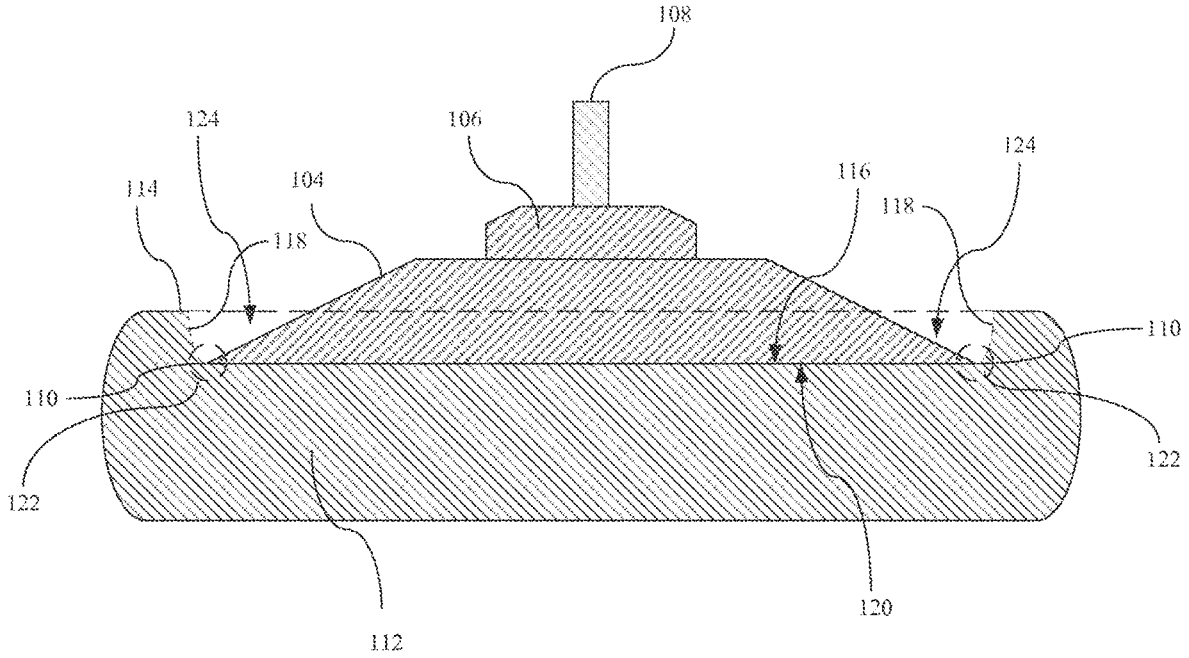
Figure 1C (Prior Art)
FIG. 1C is a side view of both the back plate and buffing pad, shown in FIG. 1A, physically connected together along the front surface of the back plate and the inner surface of the buffing pad.

In one embodiment of the present invention, the insert 212 is heated not only to affix the insert 212 to the attachment means 214 and/or cavity walls, but to render the insert 212 pliable (allowing it to be molded into a desired shape). It should be appreciated that the temperature necessary to melt and/or render the insert 212 pliable may vary depending on the type and thickness of plastic (the term plastic is used herein to include thermoplastics). It should also be appreciated that the temperature necessary to melt the insert 212 may be different from the pliability temperature (i.e., the temperature at which the plastic ring can be deformed). Thus, it may be necessary to first heat the insert 212 to its melting point (e.g., affixing it to the attachment means 214 and/or buffing pad 202) and then heat it (or let it cool) to just above its glass transition temperature, where the insert 212 can be deformed (or formed) to create the foregoing L-shape, or the like. Once the insert 212 has been deformed (or molded) into a desired shape, it should then be cooled to harden retain its desired shape (e.g., L-shape, etc.). It is this shape/hardness that protects the cavity walls of the buffing pad 202 from the edge 110 of the back plate 100 (see FIG. 1A).

Figure 4A:
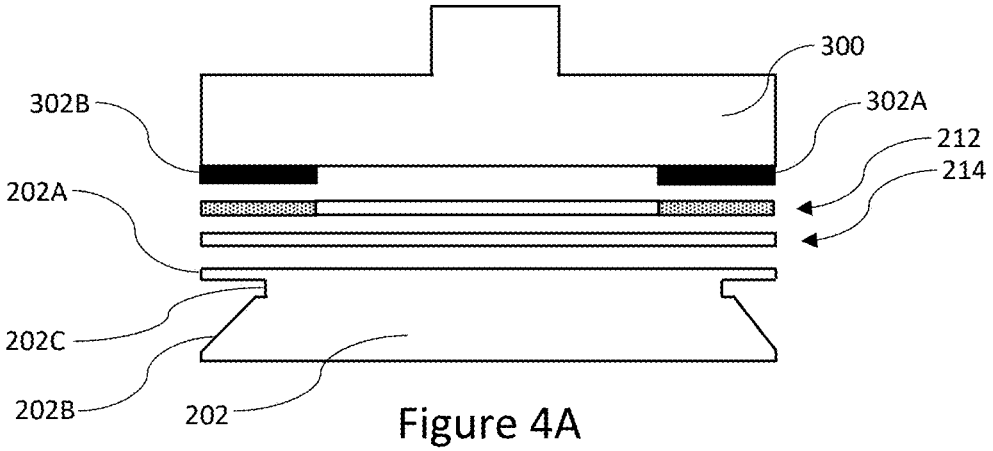
FIG. 4A is a cross-sectional, exploded view of the buffing pad assembly illustrated in FIG. 3B, along with a first tool for heating at least a plastic portion of the buffing pad assembly.

Using heat and at least one tool (see below) to form the insert 212 can also simplify and reduce the cost of manufacturing. For example, the buffing pad 202 may be cut into the profile as shown in FIG. 4A. This may be accomplished by cutting a "channel" into the side of the buffing pad, resulting in a first outer surface 202A, a second outer surface 202B (which may be angled for a more desirable profile), and a channel therebetween 202C. As discussed above, the shape of the channel will vary depending on the profile desired. After the channel has been cut into the side of the buffing pad (or prior, depending on the assembly process), the attachment means 214 is affixed to the back surface of the buffing pad 202 (e.g., via heat-resistant glue, etc.). In one embodiment, the insert 212 is then placed on the upper surface of the attachment means 214. A jig (not shown), or the like, may be used to center the insert 212 on the attachment means 214. As discussed above, the insert 212 should preferably be ring-shaped, as the cross-section illustrates in FIG. 4A.

Figure 4B:
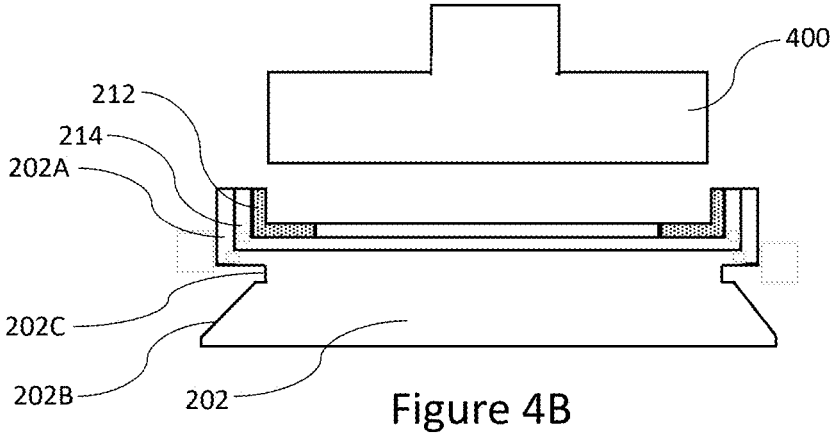
FIG. 4B is a cross-sectional, constructed view of the buffing pad assembly illustrated in FIG. 4, along with a second tool for deforming the plastic portion (while pliable), including portions of the attachment means (e.g., Velcro™) and buffing pad, thereby creating a cavity on the backside of the buffing pad assembly.

A first tool 300, having at least one heating element 302A, 302B, is then used to heat the insert 212 to its melting point, thereby affixing the insert 212 to the upper surface of the attachment means 214, which in turn is affixed to the back surface of the buffing pad 202. As shown in FIG. 4B, a second tool 400 may then be used to deform (or shape) the insert 212 into a cavity. And because the insert 212 is affixed to the attachment means 214 (or a portion thereof), and the attachment means 214 is affixed to the buffing pad 202 (or a portion thereof), shaping the insert 212 results in shaping the attachment means 214 and shaping the back surface of the buffing pad (adjacent the first outer surface 202A), thereby creating the "layered" cavity, as illustrated in the cross-sectional view of FIG. 4B.

Figure 5:
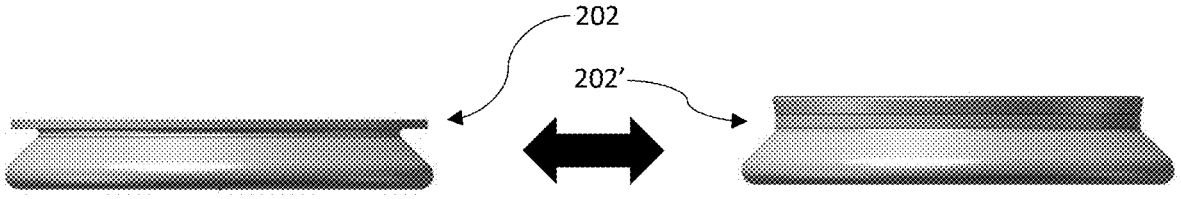
FIG. 5 illustrates both before and after pictures of a buffing pad deformed in accordance with one embodiment of the present invention.
Figure 6:
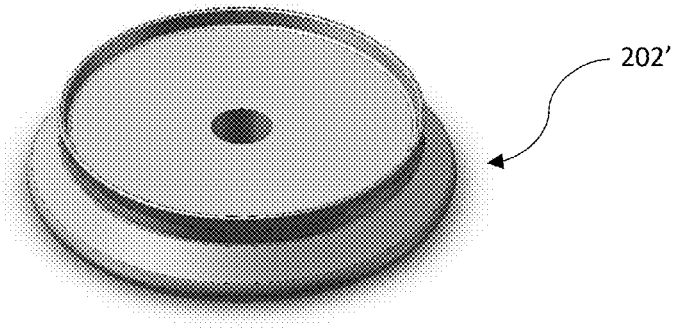
FIGS. 6-9 are perspective, side, top, and bottom views, respectively, of the buffing pad shown in FIG. 5, after deformation.
Figure 7:
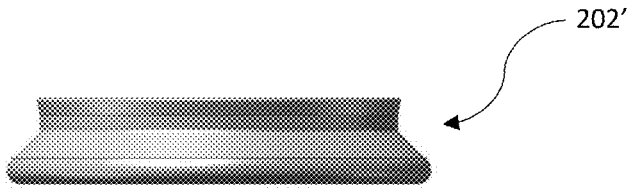
Figure 8:
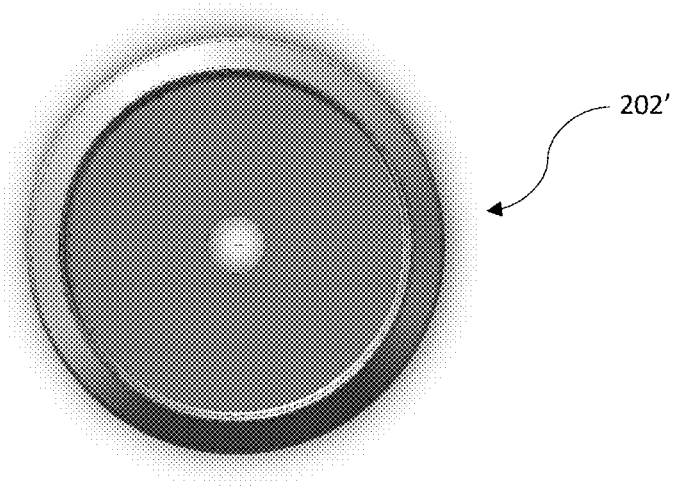
Figure 9:
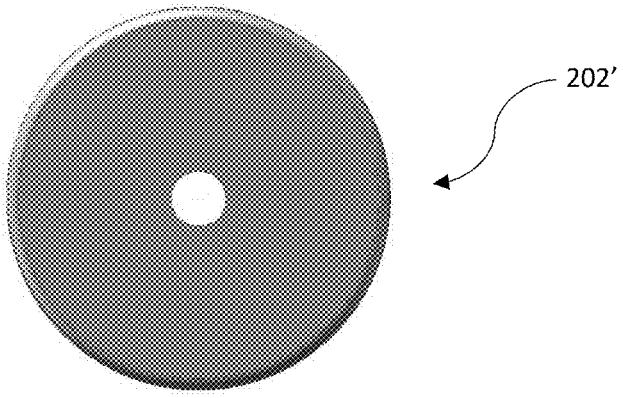

Not only does this provide a protective layer for the cavity sides, but it simplifies (and therefore reduces the cost of) the manufacturing process. For example, it is much easier (and reduces waste) to cut a channel in the side of the buffing pad than to cut a cavity into the back surface of the buffing pad. And by deforming the insert (e.g., into an L-shape) after the insert has been affixed to the attachment means and/or buffing pad, a "standard" buffing pad (i.e., flat front surface, flat back surface) with a channel cut into the side can be transformed into a flat-faced buffing pad having a cavity on its backside, as shown in FIG. 5.

Figure 17:
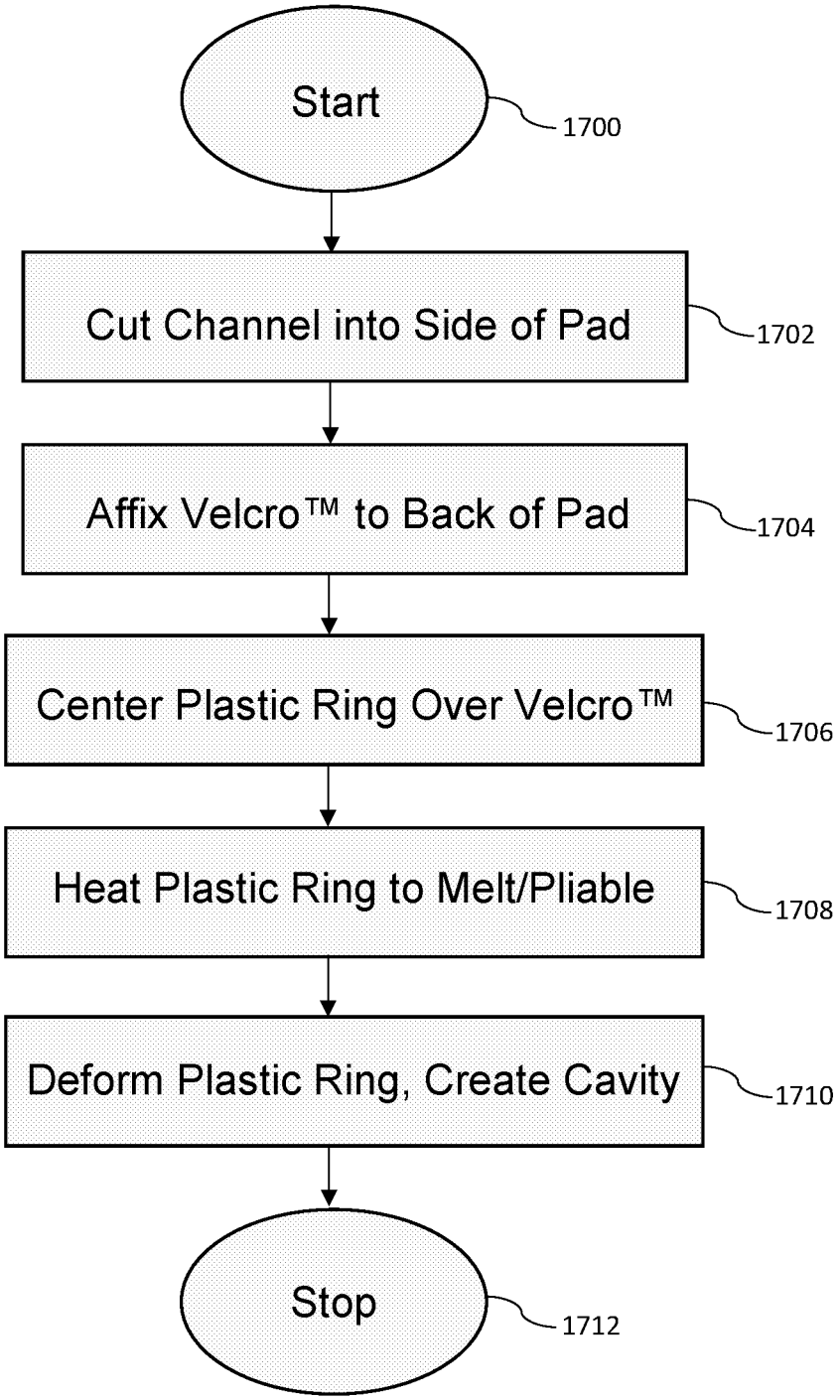
FIG. 17 illustrates a method of making a buffing pad assembly in accordance with one embodiment of the present invention.

A method of manufacturing a buffing pad assembly is accordance with one embodiment of the present invention is provided in FIG. 17. Starting at step 1700, a channel is cut into the side of the buffing pad at step 1702. The attachment means (e.g., Velcro™) is then affixed to the back surface of the buffing pad (e.g., via heat-resistant glue) at step 1704. The insert, which is preferably a plastic ring, is then placed over the upper surface of the affixing means at step 1706. As previously discussed, a jig may be used to center the insert on the affixing means. At step 1708, the insert is then heated to its melting point. The insert is then deformed into an L-shape, or the like, to create a cavity on the backside of the buffing pad assembly at step 1710, ending the method at step 1712. This deformation may be performed while the insert is at its melting point, or after it has cooled (e.g., closer to its glass transition temperature). It should, however, be held in the desired shape until the insert has cooled below its glass transition (or pliable) temperature, allowing the desired shape to be maintained.

Figure 10:
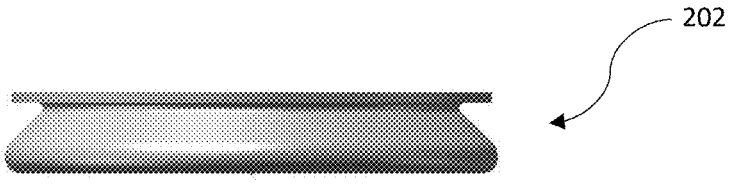
FIGS. 10-12 are side and perspective views, respectively, of the buffing pad shown in FIG. 5, before deformation.
Figure 11:
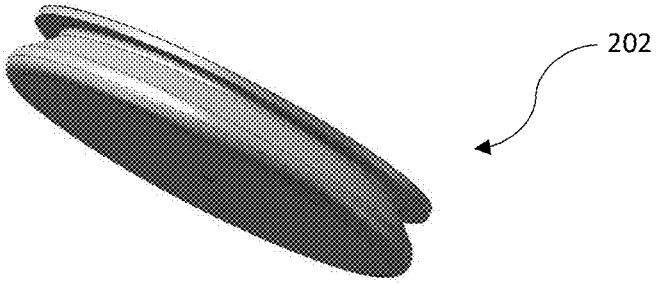
Figure 12:
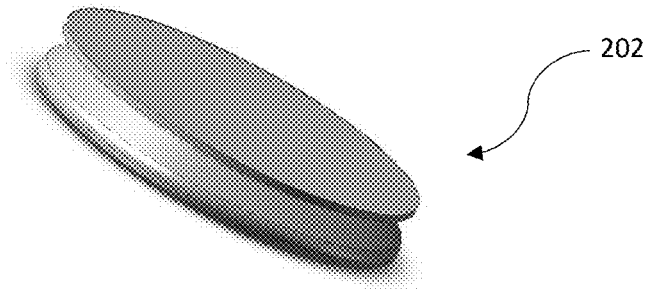
Figure 13:
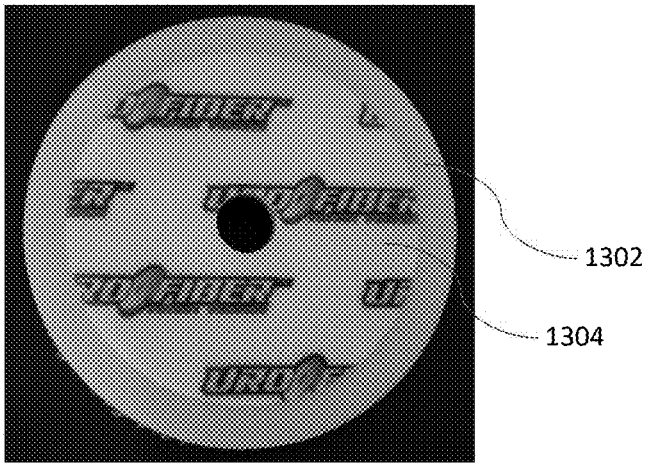
FIGS. 13 and 14 are top and bottom views, respectively, of a buffing pad assembly in accordance with another embodiment of the present invention, before deformation.
Figure 14:
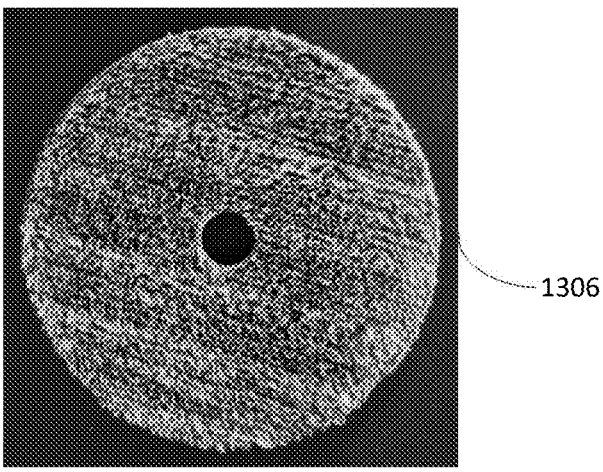

Examples of a buffing pad 202 after step 1702 (after the "channel" has been cut) are provided in FIGS. 10-12, and examples of a buffing pad 202' after step 1710 (after the insert has been deformed) are provided in FIGS. 6-9. It should be appreciated that FIGS. 6-12 merely depict the buffing pad (202, 202'), and do not depict the attachment means or the insert. They are merely being provided to illustrate how the insert, once heated and deformed, can be used to transition the buffing pad from a first configuration (FIG. 10-12) (i.e., 202) into a second configuration (FIG. 6-9) (i.e., 202').

It should be appreciated that the present invention is not limited to the manufacturing method described in FIG. 17, and ones involving additional, fewer, and/or different steps are within the spirit and scope of the present invention. For example, a different "channel" may be cut into the side of the buffing pad, depending on the desired profile. Alternatively, the method may not require the cutting of a "channel." Such an embodiment can be seen in FIGS. 13-16, where deforming the insert results in a cavity on the backside of the buffing pad assembly (as in the other embodiments). However, because a channel is not cut into the side of the buffing pad (i.e., 1302 before deformation and 1302' after deformation), deforming the insert results in a curved front surface (around the edges, see FIG. 15). By way of another example, a single tool (or more than two tools) may be used to heat and deform the insert, which may be molded into any shape desired (e.g., one having a substantially vertical portion, a substantially horizontal portion, and a slight curvature therebetween, etc.).

Having thus described a preferred embodiment for a buffing pad assembly, it should be apparent to those skilled in the art that certain advantages have been achieved. It should also be appreciated that various modifications, adaptations, and alternative embodiments thereof may be made within the scope and spirit of the present invention. The invention is further defined by the following claims.

What is claimed is:

1. A buffing pad assembly, comprising:

a buffing pad having a front surface, a back surface, and a side surface connecting said front surface to said back surface, said front surface being configured to at least one of buff and polish a vehicle, and said side surface comprises an upper side surface adjacent said back surface and a lower side surface adjacent said front surface;

an attachment means having an inner surface and an outer surface, wherein said inner surface is affixed to said back surface of said buffing pad and said outer surface is configured to connect said buffing pad assembly to a rotary portion of at least one of a rotary and orbital machine; and a plastic material affixed to a portion of said outer surface of said attachment means, wherein said plastic material is curved upward, resulting in a portion of said attachment means and said upper side of said side surface being curved upward, thereby creating a cavity on a backside of said buffing pad assembly for accepting at least said rotating portion of said at least one of said rotary and orbital machine;

wherein said buffing pad is substantially circular and said plastic material comprises a plastic ring so that said backside of said buffing pad assembly only has plastic around its edges and not its center where said attachment means comes into contact with said rotating portion of said at least one of said rotary and orbital machine.

2. The buffing pad assembly of claim 1, wherein a channel is cut into said side surface of said buffing pad, said channel being between said upper side surface and said lower side surface of said buffing pad.

3. The buffing pad assembly of claim 2, wherein said channel comprises at least a top and a bottom, wherein said top of said channel is substantially parallel to said back surface of said buffing pad prior to said plastic material being curved upward.

4. The buffing pad assembly of claim 3, wherein said bottom of said channel creates an angle with respect to said top of said channel, said angle being greater than zero degrees and less than ninety degrees.

5. The buffing pad assembly of claim 1, wherein said attachment means is affixed to said back surface of said buffing pad via a heat-resistant glue.

6. The buffing pad assembly of claim 1, wherein heating said plastic material results in said portion of said attachment means and said upper side of said surface being curved upward.

7. The buffing pad assembly of claim 1, wherein said plastic material is affixed to said portion of said outer surface of said attachment means via heat, thereby melting said plastic material to said portion of said outer surface of said attachment means.

8. A buffing pad assembly, comprising:

a buffing pad having a front surface, a back surface, and a side surface connecting said front surface to said back surface, said front surface being configured to at least one of buff and polish a vehicle, and said side surface comprises an upper side surface adjacent said back surface and a lower side surface adjacent said front surface;

an attachment means having an inner surface and an outer surface, wherein said inner surface is affixed to said back surface of said buffing pad and said outer surface is configured to connect said buffing pad assembly to a rotary portion of at least one of a rotary and orbital machine; and a plastic material affixed to a portion of said outer surface of said attachment means, wherein said plastic material is curved upward, resulting in a portion of said attachment means and said upper side of said side surface being curved upward, thereby creating a cavity on a backside of said buffing pad assembly for accepting at least said rotating portion of said at least one of said rotary and orbital machine;

wherein said plastic material is affixed to said portion of said outer surface of said attachment means via heat, thereby melting said plastic material to said portion of said outer surface of said attachment means; and wherein a diameter of said attachment means is less than both (i) a diameter of said back surface of said buffing pad and (ii) a diameter of said plastic material, thereby resulting in said plastic material being affixed to both (a) said portion of said outer surface of said attachment means and (b) a portion of said back surface of said buffing pad.

9. A buffing pad assembly, comprising:

a substantially cylindrical buffing pad having a front surface, a back surface, and a side surface connecting said front surface to said back surface, said front surface being configured to at least one of buff and polish a vehicle, and said side surface comprises an upper side surface adjacent said back surface and a lower side surface adjacent said front surface;

an attachment means having an inner surface and an outer surface, wherein said inner surface is affixed to said back surface of said buffing pad and said outer surface is configured to connect said buffing pad assembly to a rotary portion of at least one of a rotary and orbital machine, said attachment means comprising at least a portion of a hook-and-pile fastener; and a substantially cylindrical plastic ring affixed to at least a portion of said outer surface of said attachment means so that said backside of said buffing pad assembly only has plastic around its edges and not its center where said attachment means comes into contact with said rotating portion of said at least one of said rotary and orbital machine, wherein a portion of said plastic ring is curved upward, resulting in a curvature upward of a portion of said attachment means and said upper side of said side surface, thereby creating a cavity on a backside of said buffing pad assembly for receiving said rotary portion of at least one of a rotary and orbital machine.

10. The buffing pad assembly of claim 9, wherein said side surface of said buffing pad further comprises a channel between said upper and lower side surfaces.

11. The buffing pad assembly of claim 10, wherein heat is used to deform said plastic ring from an initially flat orientation to a second orientation wherein said portion of said plastic ring is curved upward.

12. The buffing pad assembly of claim 11, wherein said channel comprises at least a top and a bottom, wherein said top of said channel is substantially parallel to said back surface of said buffing pad when said plastic ring is in said initially flat orientation.

13. The buffing pad assembly of claim 11, wherein said heat is further used to affix said plastic ring to said at least a portion of said outer surface of said attachment means.

14. The buffing pad assembly of claim 11, wherein a diameter of said attachment means is substantially equal to an outer diameter of said plastic ring when said plastic ring is in said initially flat orientation.

15. The buffing pad assembly of claim 11, wherein deforming said plastic ring from said initially flat orientation to said second orientation further results in deforming said upper side surface of said buffing pad from a first orientation that is substantially parallel to said back surface of said buffing pad to a second orientation that is curved upward.

16. The buffing pad assembly of claim 9, wherein a diameter of said attachment means is less than both (i) a diameter of said back surface of said buffing pad and (ii) a diameter of said plastic ring, thereby resulting in said plastic ring being affixed to both (a) said portion of said outer surface of said attachment means and (b) a portion of said back surface of said buffing pad.

17. The buffing pad assembly of claim 9, wherein said portion of said plastic ring is curved upward after said plastic ring is affixed to said at least a portion of said outer surface of said attachment means.

18. The buffing pad assembly of claim 9, wherein a diameter of said portion of said attachment means curved upward is smaller than a diameter of said front surface of said buffing pad.

19. The buffing pad assembly of claim 9, wherein said lower side surface is angled with respect to said front surface of said buffing pad, said angle being greater than zero degrees and less than ninety degrees.

20. The buffing pad assembly of claim 9, wherein said buffing pad further comprises an aperture through a center of said buffing pad.

* * * * *